US009383698B2

(12) United States Patent
Fujie et al.

(10) Patent No.: US 9,383,698 B2
(45) Date of Patent: Jul. 5, 2016

(54) SUBSTRATE, FIXING BELT WITH SUBSTRATE, FIXING DEVICE WITH FIXING BELT, AND IMAGE FORMING APPARATUS

(71) Applicants: Kengo Fujie, Kanagawa (JP); Yasuomi Mikami, Kanagawa (JP); Yasuhide Fujiwara, Kanagawa (JP); Yuzuru Kudoh, Kanagawa (JP); Takaaki Konno, Kanagawa (JP)

(72) Inventors: Kengo Fujie, Kanagawa (JP); Yasuomi Mikami, Kanagawa (JP); Yasuhide Fujiwara, Kanagawa (JP); Yuzuru Kudoh, Kanagawa (JP); Takaaki Konno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/260,734

(22) Filed: Apr. 24, 2014

(65) Prior Publication Data

US 2014/0328610 A1 Nov. 6, 2014

(30) Foreign Application Priority Data

May 1, 2013 (JP) ..... 2013-096586
May 31, 2013 (JP) ..... 2013-115195

(51) Int. Cl.
*G03G 15/20* (2006.01)

(52) U.S. Cl.
CPC ..... *G03G 15/206* (2013.01); *G03G 15/2057* (2013.01); *G03G 2215/2035* (2013.01)

(58) Field of Classification Search
CPC ..... G03G 15/206; G03G 15/2057; G03G 2215/2035
USPC ..... 399/333, 329
See application file for complete search history.

(56) References Cited

U.S. PATENT DOCUMENTS

| | | | | |
|---|---|---|---|---|
| 7,558,519 | B2 | 7/2009 | Jinzai et al. | |
| 2002/0146259 | A1 | 10/2002 | Zhou et al. | |
| 2005/0100373 | A1* | 5/2005 | Kishino et al. | 399/329 |
| 2005/0142351 | A1* | 6/2005 | Takagi et al. | 428/323 |
| 2006/0216078 | A1* | 9/2006 | Higashi et al. | 399/333 |
| 2007/0147914 | A1 | 6/2007 | Takahashi et al. | |
| 2007/0223979 | A1* | 9/2007 | Jinzai et al. | 399/333 |
| 2014/0241771 | A1 | 8/2014 | Endo et al. | |

FOREIGN PATENT DOCUMENTS

| | | |
|---|---|---|
| JP | 2002-148975 | 5/2002 |
| JP | 2002-258648 | 9/2002 |
| JP | 2005-121825 | 5/2005 |
| JP | 2006-47766 | 2/2006 |
| JP | 2012-168264 | 9/2012 |

OTHER PUBLICATIONS

Machine translation of abstract of reference Takagi (Pub No. JP 09-034,286 A), Pub Date Feb. 7, 1997.*
Extended Search Report issued Sep. 4, 2014 in European Patent Application No. 14165829.4.

* cited by examiner

*Primary Examiner* — Rodney Bonnette
(74) *Attorney, Agent, or Firm* — Oblon, McClelland, Maier & Neustadt, L.L.P.

(57) ABSTRACT

A fixing belt substrate for an image forming apparatus is prepared by an electroforming process. The fixing belt substrate contains nickel of prescribed weight percent, phosphorus of from about 0.4 weight percent or more to about 0.7 weight percent or less, sulfur of from about 0.003 weight percent or more to about 0.02 weight percent or less, and carbon of from about 0.012 weight percent or more to about 0.03 weight percent or less.

42 Claims, 8 Drawing Sheets

SUBSTRATE, FIXING BELT WITH SUBSTRATE, FIXING DEVICE WITH FIXING BELT, AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2013-096586, filed on May 1, 2013 and 2013-115195, filed on May 31, 2013 in the Japan Patent Office, the entire disclosures of which are hereby incorporated by reference herein.

BACKGROUND

1. Technical Field

This invention relates to a fixing belt substrate for an image forming apparatus employed in a fixing device included in an image forming apparatus, such as a copier, a printer, a facsimile machine, etc., that adopts electro-photography to fix an unfixed toner image, and to a fixing belt with such a substrate, a fixing device with the fixing belt, and an image forming apparatus with the fixing device.

2. Related Art

In response to recent demand for shortening a warm-up time and saving energy in the image forming apparatus, the fixing device that is a component of the image forming apparatus is increasingly downsized while reducing its heat capacity. At the same time, there is also increasing demand for high-speed printing. Accordingly, a fixing belt, which is a component of the fixing device to effectively convey heat to toner, is expected to be both compact and durable.

As shown in FIG. 10, a conventional fixing device 60 employs a fixing belt 61 wound around a fixing roller 62 and a heating roller 65 that acts as a winding roller wound by the fixing belt 61. A pressing roller 63 is biased toward the fixing roller 62 across the fixing belt 61. With such a configuration, a transfer medium (e.g. a transfer sheet) 64 is conveyed between the fixing belt 61 and the pressing roller 63 to fix a toner image formed on the transfer medium 64 thereonto.

Inside the hollow heating roller 65, a heater 66 such as a halogen lamp, etc., is placed along a rotation axis of the heating roller 65. Thus, radiant heat emitted from the heater 66 is transferred to the fixing belt 61 through the heating roller 65 heated by the radiant heat.

In the conventional fixing device 60, an endless belt made of polyimide resin, etc., is used as the fixing belt 61. However, in the conventional fixing device 60, since there is a relatively long distance between the nip to fix the toner image and the heat source, heat-transferring efficiency is relatively low. In addition, since the conventional fixing device 60 includes various components, and accordingly heat capacity of the fixing device as a whole is relatively large, it takes a relatively long time to reach a sufficient level needed to fuse the toner onto the recording medium (i.e., a start-up time).

Accordingly, in recent years, a fixing device as shown in FIG. 2, in which a fixing belt is driven and rotated by a pressing roller to shorten the startup time (sometimes called a quick start-up (QSU) fixing device) has been proposed. With such a structure, the problems of low heat transfer efficiency and lengthy startup time are solved by effectively shortening a diameter of it and accordingly a length of the fixing belt while laying out the heat source inside the fixing belt. To transfer heat from the heater to the nip, whereas the fixing belt 61 used in the conventional fixing device of FIG. 10 is driven by a gear train, not shown, and multiple rollers 62 and 65, by contrast the fixing belt 5 used in the fixing device of FIG. 2 is driven by the pressing roller 14 in contact with an outer circumferential surface of the fixing belt 5 as the pressing roller 14 rotates. Consequently, a larger load is imposed on the fixing belt 5 of the fixing device of FIG. 2 than in the conventional fixing device of FIG. 10, and strength thereof is possibly insufficient if it is made of resin such as polyimide, etc. For this reason, in the fixing device of FIG. 2, a fixing belt substrate 71 is frequently made of metal, such as stainless steel (i.e., SUS (Steel Use Stainless)), nickel, aluminum, copper, etc., having great strength.

Although a configuration like that described above is generally effective for its intended purpose of providing good durability, a problem arises when the fixing device of FIG. 2 is used for high-speed printing in that separation of the performance to separate a transfer medium from the fixing belt 5 is insufficient and needs to be improved. In such a situation, when the fixing belt 5 is both shortened and rotated at high speed, sufficient time cannot be ensured for toner T that has adhered to a surface of the fixing belt 5 from the transfer medium 64 due to the heat to separate from the surface of the fixing belt 5. Consequently, the transfer medium is attracted to the surface and caught by the fixing belt 5 as it rotates.

As a general solution for this problem, release of the transfer medium from the fixing belt 5 is improved by reducing a radius of curvature of the fixing belt 5 near a nip exit 7 of a sheet path while relying on rigidity of the transfer medium. However, due to the small radius of curvature, the load on the fixing belt 5 further grows as a result.

It is noted that nickel is more preferably used as the fixing belt substrate 71 of the fixing device of FIG. 2 than stainless steel because nickel has superior durability and strength, and facilitate an electroforming process manufacturing the endless belt.

When preparing the fixing belt substrate made of such electroformed nickel, prescribed amounts of phosphorus, sulfur, and carbon are mixed into the substrate to improve its heat resistance and mold releasability. Also, to enhance durability of the substrate of electroformed nickel, its crystal orientation ratio is controlled.

To ensure the mold releasability of the fixing belt to separate from toner, a releasing layer composed of fluoropolymer resin having excellent releasability is generally established on a surface of the substrate. To form the mold-releasing layer, heating to more than 300 degree Celsius is frequently required. However, subjecting the fixing belt substrate made of the electroformed nickel to such high-temperature heating makes the fixing belt substrate brittle, thereby reducing durability thereof. Moreover, reliable durability of the substrate may be hard to obtain as the fixing belt becomes more compact and rotated at higher speeds.

SUMMARY

Accordingly, one aspect of the present invention provides a novel fixing belt substrate prepared by an electroforming process. The fixing belt substrate includes nickel of prescribed weight percent, phosphorus of from about 0.4 weight percent or more to about 0.7 weight percent or less, sulfur of from about 0.003 weight percent or more to about 0.02 weight percent or less, and carbon of from about 0.012 weight percent or more to about 0.03 weight percent or less.

Another aspect of the present invention provides a novel fixing belt having a substrate prepared by an electroforming process. The substrate includes nickel of prescribed weight percent, phosphorus of from about 0.4 weight percent or more to about 0.7 weight percent or less, sulfur of from about 0.003 weight percent or more to about 0.02 weight percent or less, and carbon of from about 0.012 weight percent or more to about 0.03 weight percent or less.

Yet another aspect of the present invention provides a novel fixing device including a fixing belt having a substrate prepared by an electroforming process. The substrate includes nickel of prescribed weight percent, phosphorus of from about 0.4 weight percent or more to about 0.7 weight percent or less, sulfur of from about 0.003 weight percent or more to about 0.02 weight percent or less, and carbon of from about 0.012 weight percent or more to about 0.03 weight percent or less.

Yet another aspect of the present invention provides a novel image forming apparatus including a fixing belt having a substrate prepared by an electroforming process. The substrate includes nickel of prescribed weight percent, phosphorus of from about 0.4 weight percent or more to about 0.7 weight percent or less, sulfur of from about 0.003 weight percent or more to about 0.02 weight percent or less, and carbon of from about 0.012 weight percent or more to about 0.03 weight percent or less.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 2:
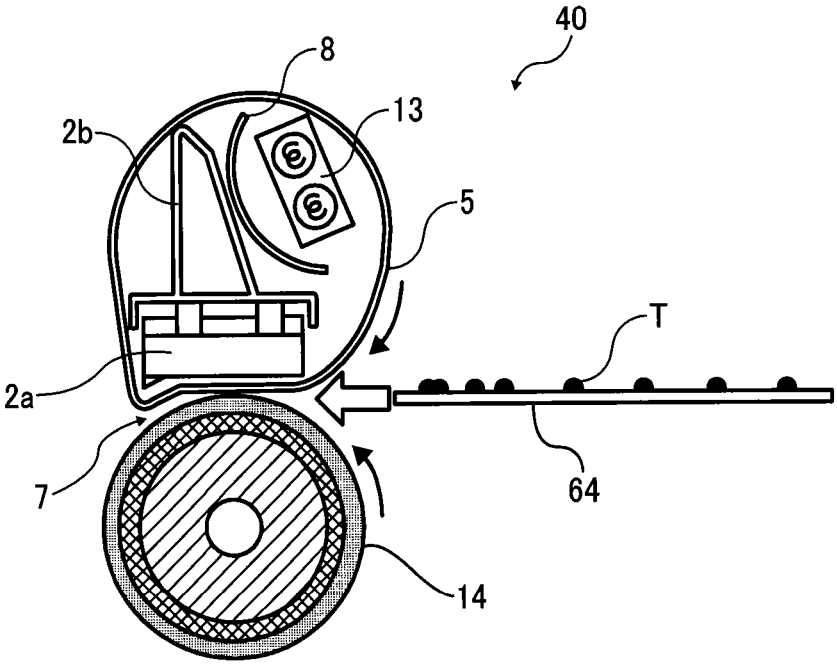
FIG. 2 is a diagram typically illustrating an exemplary fixing device having the fixing belt of FIG. 1 according to one embodiment of the present invention.

Referring now to the drawings, wherein like reference numerals designate identical or corresponding parts throughout the several views thereof and in particular to FIG. 2, a configuration and operation of a fixing belt 5 included in a fixing device 40 is described. The fixing belt 5 is driven and rotated as a pressing roller 14 rotates. Specifically, the fixing belt 5 is pressed and curved by the pressing roller 14, thereby forming a wide nip thereon as shown there. That is, the nip is formed as the pressing roller 14 facing the fixing belt 5 sandwiches the fixing belt 5 together with an internal stay as a reinforcing member 2*b* and a sliding pad as a fixed member 2*a*.

Thus, the fixing belt 5 used in this type of the fixing device 40 shown in FIG. 2 repeatedly deforms at the nip when it is rotated by the pressing roller 14 in a prescribed direction as shown by an arrow in the drawing. Accordingly, load on the fixing belt 5 significantly grows more than that on the conventional fixing belt of the fixing device of FIG. 10.

To increase a fixing speed, a rotational speed of the fixing belt 5 needs to be enhanced. When the rotational speed is enhanced in this way, mold releasability of a transfer medium (i.e., a transfer sheet) 6 generally deteriorates as a problem. To separate toner T adhering to the fixing belt 5 when passing through the nip therefrom, a prescribed method is proposed to encourage mold releasing of the transfer medium 64 by minimizing a radius of curvature of the fixing belt 5 at a nip exit 7 while using a rigidity of the transfer medium 64 as shown in FIG. 2. In this method, bending load on the fixing belt 5 becomes the maximum at the nip exit 7 due to the minimum radius of curvature provided to ease the mold releasing.

In the fixing device 40 shown in FIG. 2, the fixing belt 5 is heated directly by light emitted from a halogen heater 13 acting as a heating source and light reflected from a reflecting plate 8 acting as a reflective member that reflects the light emitted from the halogen heater 13 toward the fixing belt 5. Specifically, in the fixing device 40, a portion of the fixing belt 5 on an upstream side of the nip in a rotational direction is intensively heated by the light directly emitted from the halogen heater 13 and that reflected by the reflecting plate 8.

Figure 10:
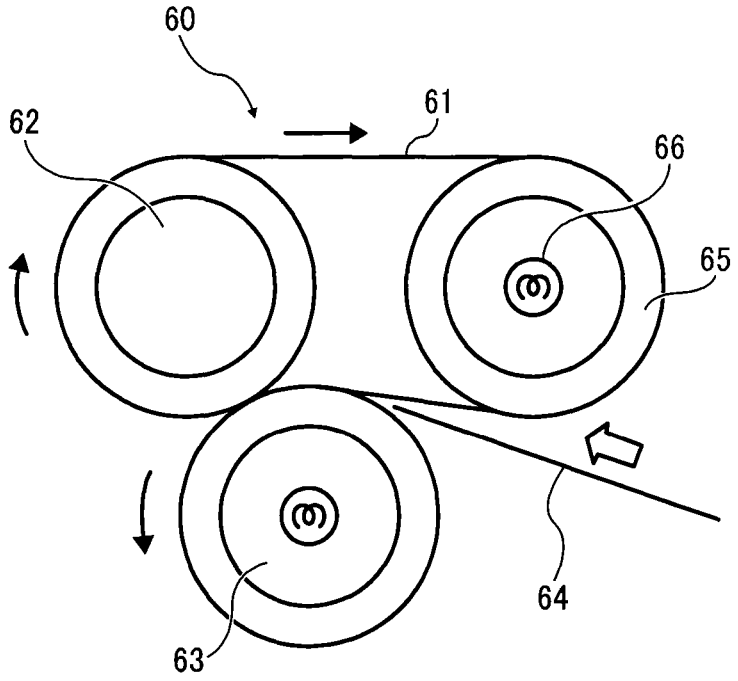
FIG. 10 PRIOR ART
FIG. 10 is a diagram illustrating a conventional fixing device.

By contrast, in the conventional fixing device 60 of FIG. 10, heat of a heater 66 as a heating source is transmitted therefrom to the fixing belt 61 through a heating roller 65 that widely contacts the fixing belt 61 at a prescribed position.

In this way, since the fixing belt 5 used in the fixing device 40 is configured to directly receive the heat from the heat source, it likely becomes hotter than the fixing belt 61 of the conventional fixing device 60 of FIG. 10, and accordingly likely becomes brittle due to the heat as a result.

A fixing belt used in a conventional fixing device is generally made of polyimide and is integrally formed by molding thereof. On the other hand, a fixing belt utilizing a metal substrate has a three-tier structure as typically shown in FIG. 1. That is, the fixing belt (utilizing metal substrate) generally includes an elastic layer 72 to widen a nip width and a mold-releasing layer 73 to prohibit adhesion of toner melting on a transfer medium overlying the belt substrate 71 in this order. Thus, thermal processing applied during formation of the elastic and mold-releasing layers possibly renders nickel to be brittle. Especially, when the mold-releasing layer is made of fluoride based resin, high temperature processing at over 30 degree Celsius may be required and applied thereto for 30 minutes.

Hence, the fixing belt 5 used in the fixing device 40 shown in FIG. 2 is expected to bear repetitious bending deformation at the nip and various loads, such as heat directly transferred from the heat source, sintering at high temperature, etc. To speed up such a fixing device 40, more highly durable the fixing belt substrate 71 is required.

Now, result of investigation of an impact of an electroformed nickel film containing 0.5 weight percent of phosphorus on its tear strength when the amount of sulfur included therein is changed is described with reference to FIG. 4. The result is obtained on conditions that a thickness of the electroformed film is 30 μm, while thermal processing is executed at 340 degree Celsius for one hour by supposing a condition, under which thermal processing is applied to form the mold-releasing layer.

The tear strength is an assessment indicators determined by a right angle tear method in compliance with the Japanese standard (JIS-K7128-3). That is, as stated in this standard, a sample having a right-angle shape is cut out from the electroformed film, and is given tensile loads on its both ends. Then, the maximum load applied thereto when it is torn is regarded as the tear strength.

Figure 4:
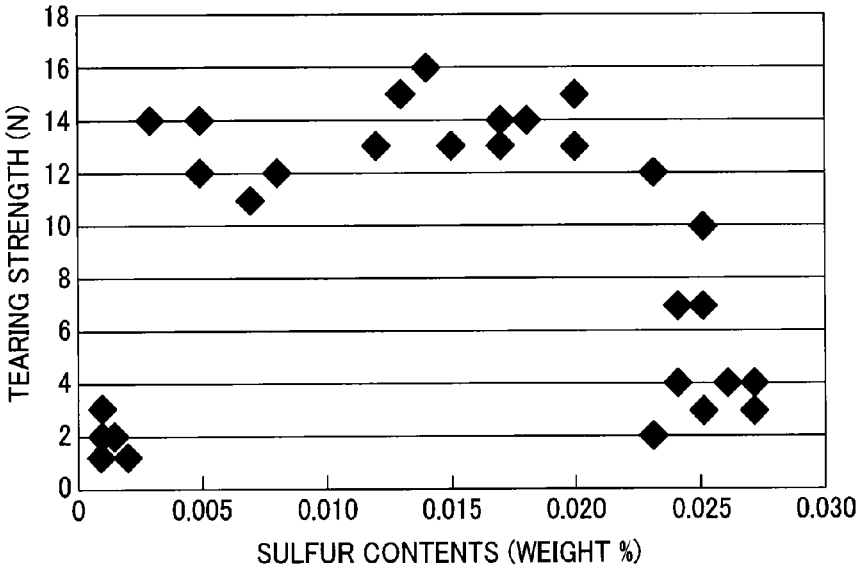
FIG. 4 is a graph illustrating result of investigation, in which an impact of an electroformed nickel film on tear strength is investigated by changing the sulfur content therein, according to one embodiment of the present invention.

As can be understood from FIG. 4, in a range of the sulfur content from about 0.003 weight percent to about 0.02 weight percent, tear strength after high temperature processing is relatively high and is upgraded as the sulfur contents increases as well.

Now, result of investigation of an impact of the electroformed nickel film containing 0.5 weight percent of phosphorus and 0.015 weight percent of sulfur on tear strength when the amount of carbon and accordingly micro-Vickers hardness is changed is described with reference to FIG. 5.

Figure 5:
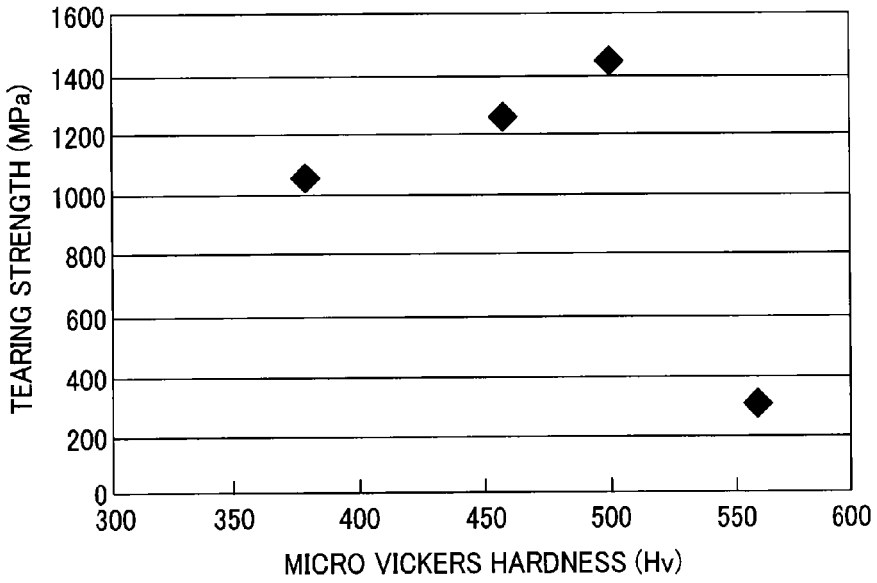
FIG. 5 is a graph illustrating result of investigation, in which an impact of an electroformed nickel film on tear strength is investigated by changing the carbon content and accordingly micro-Vickers hardness of the electroformed nickel film that contains 0.5 weight percent of phosphorus and 0.015 weight percent of sulfur (obtained in a basic consideration), according to one embodiment of the present invention.

As understood from FIG. 5, in the range of micro-Vickers hardness from 460 or more to 550 or less, tensile strength is relatively high, and grows as the hardness increases as well. By using material having high tensile strength in this way, a reliable fixing belt can be realized.

It has been recognized that the fixing belt substrate used in the fixing device shown in FIG. 2 especially needs two performances of the tearing strength (i.e., fracture toughness) and the tensile strength (i.e., durability) shown after high-temperature processing. As such, according to one embodiment of the present invention, the durability and fracture toughness of the fixing belt are obtained by varying contents contained in nickel of the fixing belt substrate as described above.

Specifically, the fixing belt substrate according to one embodiment of the present invention includes nickel as a main component prepared by using the above-described electroforming method. The fixing belt substrate of one embodiment of the present invention also includes the below described various characteristics when the amount of phosphorus ranges from about 0.4 weight percent or more to about 0.7 weight percent or less, the amount of sulfur ranges from about 0.003 weight percent or more to about 0.02 weight percent or less, and the amount of carbon ranges from about 0.012 weight percent or more to about 0.03 weight percent or less.

That is, strength of the fixing belt substrate is enhanced by mixing phosphorus thereinto. This is considered that phosphorus atoms are liquidized in a metal crystal lattice of nickel and generate a distorted organization.

However, when the amount of phosphorus is too low, sufficient growth of strength cannot be expected. By contrast, when the amount of phosphorus is too high, a surface of electroformed products contacting an electroforming mother die becomes smaller when it is deposited therein. As a result, the electroformed products become smaller than the electroforming mother die. Consequently, the electroformed products apply a stress to the electroforming mother die in a prescribed direction to tighten the electroforming mother die, and accordingly removal thereof from the electroforming mother die becomes difficult. Hence, it is more favorable that the amount of phosphorus ranges from about 0.5 weight percent or more to about 0.7 weight percent or less.

The sulfur in the fixing belt substrate functions to make nickel crystal grains finer and accordingly enhances strength of the fixing belt substrate. However, when the amount of the sulfur is too low, sufficient strength of the fixing belt substrate cannot be obtained. By contrast, when the amount of sulfur is too high, the fixing belt substrate tends to be brittle while deteriorating durability as well. Hence, the more desirable sulfur content is from about 0.012 weight percent or more to about 0.018 weight percent or less.

Also, the carbon included in the fixing belt substrate smoothens a depositing surface of the nickel during the electroforming process, thereby providing gloss and hardness of the surface of the electroformed nickel. Hence, by appropriately adjusting the carbon content, micro-Vickers hardness of from about 460 degree to about 550 degree can be obtained, for example.

Since the micro-Vickers hardness of the fixing belt substrate has a correlation with strength of material, the higher the micro-Vickers hardness is, the greater the durability of the material is. However, when the micro-Vickers hardness is too high, the material tends to show a brittle characteristic and have low durability as well.

Figure 6:
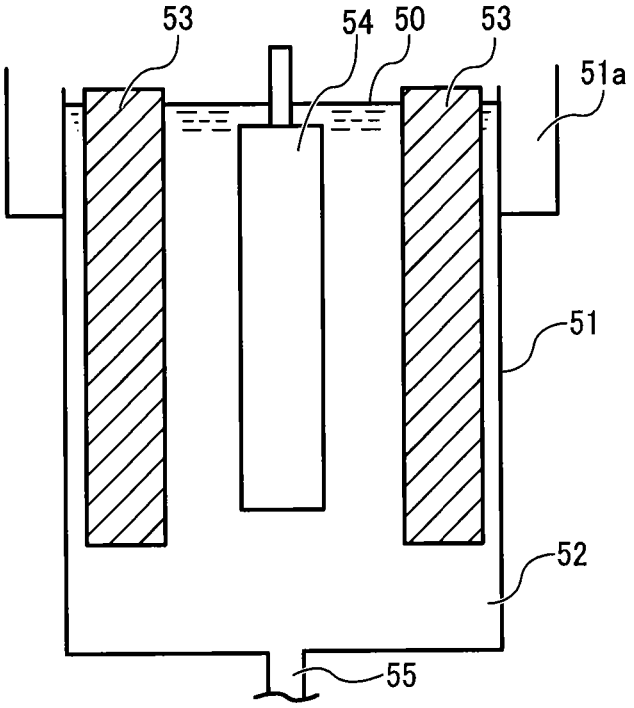
FIG. 6 is a cross-sectional view typically illustrating an electroforming chamber used in manufacturing the fixing belt substrate according to one embodiment of the present invention.

Now, according to one embodiment of the present invention, the fixing belt substrate can be obtained by the below described manner as shown in FIG. 6, for example.

That is, as shown there, a cross-sectional view of an exemplary electroforming chamber that manufactures the fixing belt substrate is illustrated. A reference number 50 indicates an electro electroforming chamber composed of a liquid tank 51 that stores nickel electroforming liquid 52 to which phosphorus is added.

A prescribed number of anode electrodes 53 (in this example, two) is placed in the liquid tank 51. At a center between the anode electrodes 53, a cylindrical electroforming mother mold 54 (also acting as a cathode electrode) is placed. The cylindrical electroforming mother mold 54 is configured to rotate around its axis so that a thickness of the fixing belt substrate is electrically uniformly formed entirely. The electroforming mother mold 54 is driven and rotated by a driving mechanism, not shown, during the electroforming process.

As shown in this example, an electroforming liquid spouting pipe 55 is also connected to the bottom of the electroforming chamber 50, so that nickel electroforming liquid 52 can be supplied to the electroforming chamber 50 from the electroforming liquid spouting pipe 55. An overflowing section 51*a* is also formed in the liquid tank 51 and is connected to the electroforming liquid spouting pipe 55 via a liquid pump, not shown. With this, the nickel electroforming liquid 52 repeatedly circulates through the liquid tank 51, the overflowing section 51*a*, and the electroforming liquid spouting pipe 55 in this order.

By electroforming in this electroforming chamber 50 that stores the nickel electroforming liquid including components of phosphorus, sulfur, and carbon, the fixing belt substrate according to one embodiment of the present invention can be obtained.

As the nickel electroforming liquid, various known electroforming liquid in this technical field can be used. However, sulfamic acid may be desirably used as the nickel electroforming solution.

As the sulfamic acid nickel electroforming solution, liquid-containing sulfamic acid nickel tetrahydrate of from about 300 g/L (liter) or more to about 600 g/L or less, nickel chloride of from about 0 g/L to about 30 g/L or less, boric acid of from about 20 g/L or more to about 40 g/L or less, and primary and secondary brightening agents may be exemplified. The measure of acidity pH of an electroforming bath is preferably from about 3.5 to about 4.5 degrees.

As the sulfamic acid bath other than the above, pH buffer agents, such as boric acid, formic acid, acetic acid nickel, etc., can be used. For the purposes of smoothening, preventing a pit, micronizing a crystal grain, and reducing residual stress or the like, brighteners, pit inhibitors, and internal stress reduction agents or the like can be added.

According to one embodiment of the present invention, as a source to supply phosphorus to be contained in the fixing belt substrate, water-soluble phosphorus-containing acid salt such as hypo phosphorous acid sodium salt, etc., is added to the nickel electroforming liquid as a phosphorus component. Other than the hypo phosphorous acid sodium salt, the water-soluble phosphorus-containing acid salt may include phosphate or phosphite and the like. Among them, because pH control of it is easy and the electroforming liquid can be stabilized, the hypo phosphorous acid sodium salt is desirably used. An added amount of the above-described hypo phosphorous acid sodium salt is previously considered and determined as follows. That is, when it is used, the hypo phosphorous acid sodium salt having concentration of from about 40 mg/L or more to about 200 mg/L or less can be added into the sulfamic acid bath, for example. When an added amount of the water-soluble phosphorus-containing acid salt is too little, durability deteriorates and a nickel (Ni) film prepared during the electroforming process sometimes peels off. By contrast, when an added amount of the water-soluble phosphorus-containing acid salt is too much, the film becomes brittle and mold releasing likely becomes impossible.

As the sulfur-containing component added to the nickel electroforming liquid, p-toluene sulfonamide, benzene sulfonic acid, naphthalene, and saccharin or the like may be exemplified. Among them, since it does not resolve in liquid and is easy to handle, the p-toluene sulfonamide is favorably used. An added amount of the above-described p-toluene sulfonamide is previously considered and determined as follows. That is, when it is used, the p-toluene sulfonamide having concentration of from about 30 mg/L or more to about 100 mg/L or less can be added into the sulfamic acid bath, for example. When an added amount of the sulfur-containing component is too little, mechanical strength likely deteriorates. By contrast, when the added amount of the sulfur-containing component is too much, the material likely becomes brittle.

As the carbon including component to be added to the nickel electroforming liquid, 2-butyne-1,4-diol, formaldehyde, and allylsulfonate acid or the like may be exemplified. Among them, these are non-volatile and are easy to handle, 2-butyne- and 4-diol are desirable. An added amount of the above-described 2-butyne-1 or 4-diol is previously considered and determined as follows. That is, when each of them is used, the 2-butyne-1 or 4-diol having concentration of from about 50 mg/L or more to about 100 mg/L or less can be added into the sulfamic acid bath, for example. When an added amount of the contained carbon component is too little, a surface of the film of nickel (Ni) likely loses gloss. By contrast, when the added amount of the contained carbon component is too much, the material possibly becomes brittle.

Here, a thickness of the fixing belt substrate is desirably from about 20 μm or more to about 200 μm or less in view of heat capacity and strength required when it constitutes the fixing belt. An especially desirable range is from about 30 μm or more to about 40 μm or less.

When an electric precipitate (i.e., electroformed products is formed by the electroforming and a thickness thereof becomes a prescribed level required for the fixing belt substrate, the electroforming process is completed. Subsequently, the electric precipitate (i.e., the electrodeposition body) obtained in this way is extracted together with the electroforming mother mold, and is washed. Ultimately, needless parts are removed from both ends of the electroforming mother mold. Subsequently, the electroforming mother mold with the electric precipitate is soaked in water, and the electric precipitate is then liberated from the electroforming mother mold. Subsequently, the electric precipitate is pulled out of the electroforming mother mold, and the fixing belt substrate according to one embodiment of the present invention is obtained.

Figure 1:
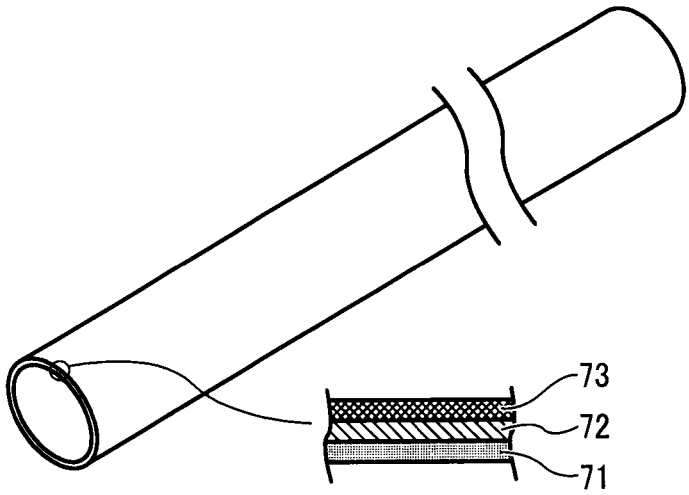
FIG. 1 is a diagram illustrating an exemplary fixing belt including a substrate according to one embodiment of the present invention.

As typically shown in FIG. 1, by forming the elastic layer 72 and the mold releasing layer on an outer circumferential surface of the fixing belt substrate obtained using a known method in this way, a fixing belt according to one embodiment of the present invention can be prepared.

Here, as performance needed for the fixing belt substrate when constituting thereof, each of durability, flexibility, and heat resistance tolerable to fusing temperature is exemplified. Accordingly, each of the elastic layer and the mold-releasing layer is formed to satisfy these performances.

The elastic layer is formed for the purpose of giving flexibility to the belt surface and thereby obtaining a uniform image without uneven gloss. A rubber hardness of the elastic layer is desirably from about 5 degrees or more (JIS-A) to about 50 degrees or less. A thickness of the elastic rubber is preferably from about 50 μm or more to about 500 μm or less. The elastic layer is desirably made of silicone rubber and fluorosilicone rubber or the like to obtain heat-resistance at fixing temperature.

On the other hand, the mold-releasing layer may be made of fluorocarbon resin, mixture of these resins, or prescribed material obtained by dispersing these fluorocarbon resins to heat-resistant plastic, for example. As the dispersed fluorocarbon resin, polytetrafluoroethylene resin (PTFE), tetra fluoride ethylene-perfuloroalkyl vinyl ether copolymer resin (PFA), and tetrafluoro ethylene-hexafluorophosphate propylene copolymer (FEP) are exemplified.

When the elastic layer is covered by the mold releasing layer made of the above-described material, toner releasability and sheet powder adhesion preventing performance can be obtained without using silicone oil (i.e., it becomes oil-less).

However, since the resin having the above-described releasability does not include elasticity like rubber in general, the flexibility of the belt surface is lost when a relatively thicker mold-releasing layer is formed on the elastic layer. Consequently, an image formed in this way generates uneven gloss.

To strike a balance between the releasability and the flexibility while considering the durability, a film thickness of the mold-releasing layer is preferably from about 4 μm or more to about 50 μm or less. The film thickness of the mold-releasing layer more favorable ranges from about 5 μm or more to about 20 μm or less. In this example, the film thickness of the mold-releasing layer is set to about 7 μm.

If necessary, a primer layer may be established between each of the above-described layers. A prescribed layer may also be provided on an inner surface of the substrate to improve durability needed during sliding movement of the fixing belt. For example, a layer made of fluorocarbon resin, such as PFA, PTFE, etc., may be provided thereon.

Now, exemplary configuration and operation of a fixing device having a fixing belt employing the substrate according to one embodiment of the present invention is described with reference to FIG. 2.

This fixing device 40 is a type in which a pressing roller is driven by a motor and the fixing belt is driven by the pressing roller 14 as it rotates. The fixing device 40 includes a fixing belt 5 as a belt member, a fixed member 2*a*, a heating pipe as a heating member (not shown), a reinforcing member 2*b*, a heater 13, and a pressing roller 14.

Now, ordinary operation of the fixing device 40 is described herein below.

When a power source switch provided in the fixing device 40 is initially turned on, power is supplied to the heater 13. At the same time, the pressing roller 14 is pressed against (or toward) the fixing belt 5 by a biasing mechanism, not shown, so that a nip is formed between the pressing roller 14 and the fixing belt 5. A driving mechanism, not shown, then starts rotating and drives the pressing roller 14.

With these actions, the fixing belt 5 accordingly rotates due to friction caused between itself and the pressing roller 14. The fixing belt 5 is configured such that the elastic layer and the mold-releasing layer are sequentially stacked on the fixing belt substrate according to one embodiment of the present invention. The total thickness of these layers is about 1 mm or less for example. The diameter of the fixing belt 5 is generally set to about 15 mm to about 120 mm, and is typically set to about 30 mm in this embodiment.

The heating pipe as a heating member is heated by radiant heat emitted from the heater 13 and heats the fixing belt 5. That is, the fixing belt 5 is indirectly heated by the heater 13 through the heating pipe. Here, as the heating member, prescribed metal having good thermal conductivity, such as aluminum, iron, stainless steel, etc., can be exemplified. In this example, the heating member is typically made of stainless steel. As the heater 13, a carbon heater or halogen heater can be used. In this example, the halogen heater 13 is typically used.

The heating member is typically formed in a pipe state, and made of aluminum having a thickness of about 0.1 mm. By setting the thickness of the heating member to about 0.2 mm or less, the fixing belt 5 can be highly effectively heated.

The reinforcing member 2*b* is intended to support and reinforce the fixed member 2*a* that forms the nip, and suppresses deformation and displacement thereof possibly caused by pressure of the pressing roller 14. To achieve the above-described function, the reinforcing member 2*b* is desirably made of metal, such as stainless steel, iron, etc., having great mechanical strength, and is typically made of the stainless steel in this example.

As described earlier, the fixed member 2*a* is provided to form the nip between the fixing belt 5 and the pressing roller 14 brought in pressure contact therewith. The fixed member 2*a* includes a rigid section composed of metal, an elastic section made of rubber, and a lubricant sheet cover that overlies the rigid and elastic sections.

The rigid section is made of metal, ceramic, etc., having high rigidity to withstand pressure in the nip, and is typically made of stainless steel in this example. A surface of the elastic section facing the pressing roller 14 is concaved to extend along a curvature of the pressing roller 14 to ensure a prescribed sufficient nip width capable of accommodating high speed fixing.

Figure 7:
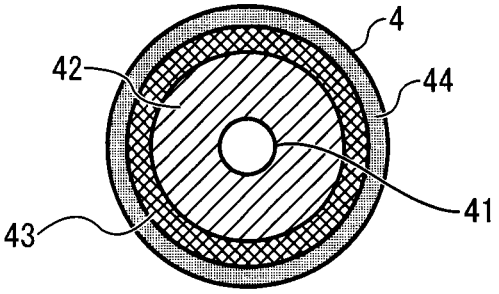
FIG. 7 is a cross-sectional view typically illustrating an exemplary configuration of a pressing roller 14 according to one embodiment of the present invention.

The pressing roller 14 that contacts an outer circumferential surface of the fixing belt in the nip as a pressure rotary member has a diameter of from about 20 mm or more to about 30 mm or less. As typically shown in a cross sectional view of FIG. 7, the pressing roller 14 has a laminated structure composed of a cylindrical metal core 41, a foam elastic layer 42 having continuous air bubbles, a solid elastic layer 43, and a mold releasing layer 45 stacked in this order. The pressing roller 14 forms the fixing nip by pressing against the fixed member 2*a* across the fixing belt 5. Outside a sheet passage area (i.e., a trunk) at both ends of the pressing roller, a pair of gripping layers is provided to contact and secure friction force for driving the fixing belt 5.

Since the foam elastic layer 42 composed of the foam elastic member with the continuous foam bubbles has good heat insulation, it can effectively shorten a time to heat up the fixing nip. The foam elastic layer 42 is made of foam silicone rubber (e.g., silicone elastomer). For example, the foam elastic layer 42 can be prepared by kneading silicone compound with foaming agents, cross-linking agents, and communicating agents, while foaming and vulcanizing thereof. Practically, the foam elastic layer 42 is formed by using the above-described method in this example. The foam elastic layer 42 can be prepared by adding water, water absorbent polymer, curing catalyst to liquid silicone rubber while stirring and hardening them in a prescribed mold. Thus, the foam elastic layer 42 can be prepared by kneading silicone compound with foaming agents, cross-linking agents, and communicating agents, while foaming and vulcanizing thereof, for example. Practically, the foam elastic layer 42 is formed by using the above-described method in this example. The foam elastic layer 42 can be prepared by adding water, water absorbent polymer, curing catalyst to liquid silicone rubber while stirring and hardening them in a prescribed mold.

In the above-described foam silicone rubber, it is favorable when a foaming magnification ranges from about 1.5 to about 3 degrees because low heat capacity and sufficient strength can be ensured. The foaming magnification is typically about 2.0 degrees in this example.

The foam elastic layer 42 is preferably prepared by a previously known so-called water foamed silicone obtained by foaming foam silicone component with liquid compounds having a higher boiling point than room temperature, such as water, alcohol, etc. With this technique, since fine and continuous air bubbles can be formed, increase in roller diameter due to thermal expansion when heated and declining of hardness thereof due to braking of the air bubble can be likely prevented, thereby improving durability. Practically, this example also employs the water foamed silicone technology.

Overlying the foam elastic layer 42 having the above-described continuous air bubbles, a solid elastic layer 43 is formed. By rendering this solid elastic layer 43 to have a thickness of from about 0.2 mm or more to about 2 mm or less, bubble braking resistance and high bonding strength can be obtained near the metal core. In this example, the thickness is typically about 0.1 mm. The solid elastic layer is made of silicone rubber considering heat-resistance in this embodiment.

The mold-releasing layer 44 is made of fluorine resin or the like considering heat resistance and prevention of toner adhesion as well. For example, PFA or PTFE is commonly used as fluorine resin. The thickness the mold-releasing layer 44 is preferably 0.1 mm or less not to enhance the surface hardness.

In this example, the mold-releasing layer is made of PFA having a thickness of about 0.03 mm.

Figure 3:
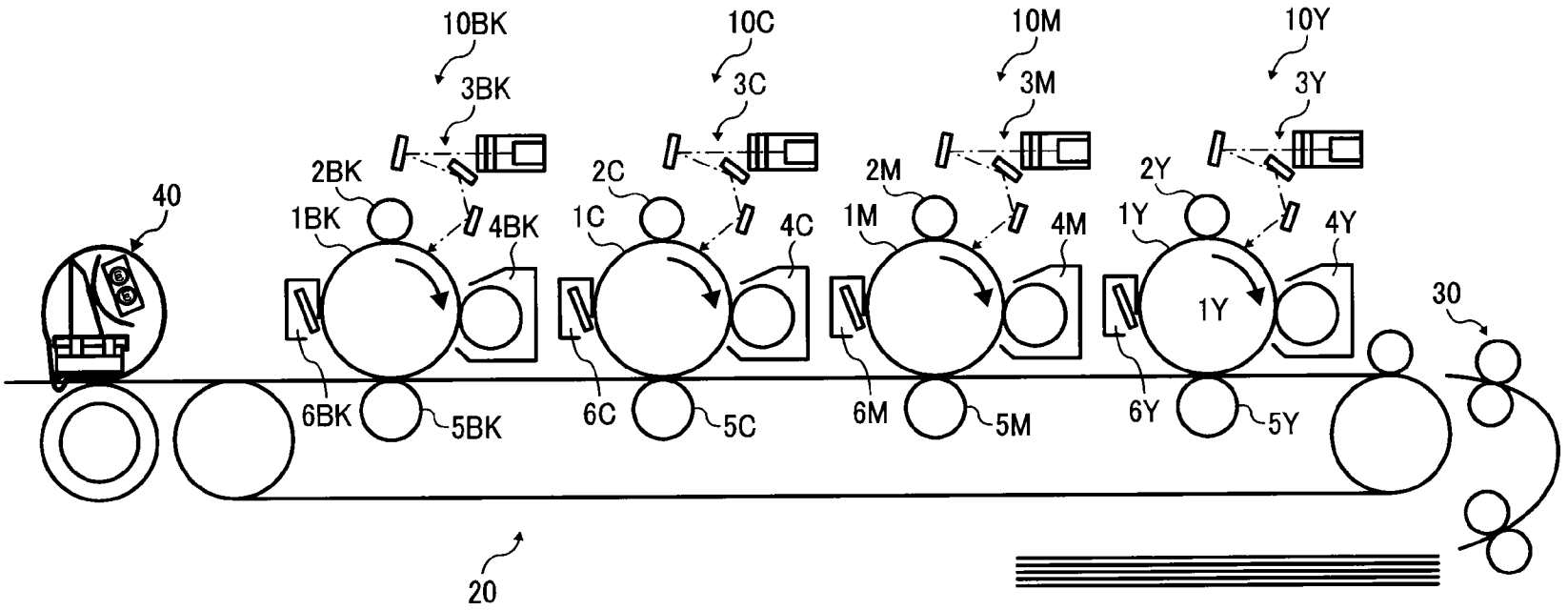
FIG. 3 is a diagram typically illustrating an exemplary image forming apparatus having the fixing device of FIG. 2 according to one embodiment of the present invention.

Now, an overall configuration and operation of an exemplary image forming apparatus (e.g. a printer) having the above-described fixing device 40 is described with reference to FIG. 3.

This printer has four pairs of image forming units to form toner images of four colors of yellow, magenta, cyan, and black, respectively. That is, to form these toner images on surfaces of the photoconductive drums (i.e., image bears) 1Y, 1M, 1C, and 1Bk corresponding to these colors, four sets of electronic image forming units (i.e., image forming devices) 10Y, 10M, 10C, and 10Bk are provided, respectively. Below these image forming units 10Y, 10M, 10C, and 10Bk, a conveying belt 20 is stretched to transfer a transfer medium (i.e., a transfer sheet) through these image forming units 10Y, 10M, 10C, and 10Bk. The photoconductive drums 1Y, 1M, 1C, and 1Bk are brought in sliding contact with the conveying belt 20. The transfer medium is electrostatically attracted to the surface of the conveying belt 20.

Since these four sets of image forming units 10Y, 10M, 10C, and 10Bk have substantially the same structure, only the yellow use image forming unit 10Y disposed uppermost stream in a sheet conveying direction is typically described.

In the image forming unit 10Y, the photoconductive drum 1Y is brought in sliding contact with the conveyor belt 20 almost at its center. Around the photoconductive drum 1Y, the below described devices are sequentially disposed in an order along a direction of rotation of the photoconductive drum 1Y. That is, a charging unit 2Y that charges the surface of the photoconductive drum 1Y with a predetermined potential, an exposing device 3Y that exposes a charged surface of the photoconductive drum 1Y to light including an image signal obtained by separating color thereby forming an electrostatic latent image thereon, a developing device 4Y that supplies yellow toner and develops the electrostatic latent image formed on the surface of the photoconductive drum 1Y, a transfer roller 5Y (i.e., a transfer device) that transfers the developed toner image onto a sheet conveyed by the conveying belt 20, a cleaner 6Y that removes residual toner on a surface of the photoconductive drum 1Y not transferred therefrom, and a charge removing lamp, not shown, that eliminates electric charge remaining on the surface of the photoconductive drum 1Y are disposed in this order.

At a right lower part of the conveying belt 20 in the drawing, a sheet feeding mechanism 30 is provided to feed a sheet onto the conveying belt 20. On the left side of the conveying belt 20 in the drawing, the fixing device 40 according to one embodiment of the present invention as described later is disposed. Thus, the transfer medium transferred by the conveying belt 20 is further conveyed along a conveying path continuously extended from the conveying belt 20 over the fixing device 40, thereby passing through the fixing device 40.

The fixing device 40 having the fixing belt with the substrate according to one embodiment of the present invention heats and presses the transfer medium bearing the respective color toner images transferred on its surface. Hence, the fixing device 40 fuses and fixes the respective toner images of different component colors on the transfer medium. The transfer medium is then ejected downstream of the fixing device 40 in the sheet transfer path by a sheet exit roller.

With the image forming apparatus that employs the substrate in the fixing belt according to one embodiment of the present invention, demands for saving energy and printing at high speed can be met. Since the image forming apparatus includes the fixing belt capable of withstanding a high load environment, a quality image can be constantly formed for a long time.

Although, only preferable embodiments of the present invention are described heretofore, the substrate, the fixing belt, the fixing device, and the image forming apparatus are not limited thereto, and various modifications can be included in the present invention.

That is, a skilled person can appropriately modify the earlier described substrate, the fixing belt, the fixing device, and the image forming apparatus in accordance with a public knowledge. However, as far as the earlier described substrate, the fixing belt, the fixing device, and the image forming apparatus are included, modifications apparently fall within the scope of the present invention.

Now, various specific examples according to one embodiment of the present invention are described with reference to FIG. 6 and applicable drawings.

For example, a sleeve state electroforming film is obtained by using an electroforming tank storing nickel electroforming liquid and an electroforming mother mold made of stainless steel having a length of about 460 mm with a thickness of about 30 mm at its trunk as typically shown in FIG. 6. In such a situation, added amounts of respective phosphorus, sulfur, and carbon-containing components are changed, and electroformed sleeve state films having different contents of phosphorus, sulfur, and carbon are obtained. Here, sodium hypophosphite is used as phosphorus-containing component. As a sulfur-containing component, p-toluene sulfonamide is used. Further, as a carbon-containing component, 4-butynediol is used.

Subsequently, the below described basic studies are carried out based on the electroformed film obtained. Here, each of the contents is obtained by executing inductively coupled plasma mass spectrometry (ICP-MS).

Figure 8:
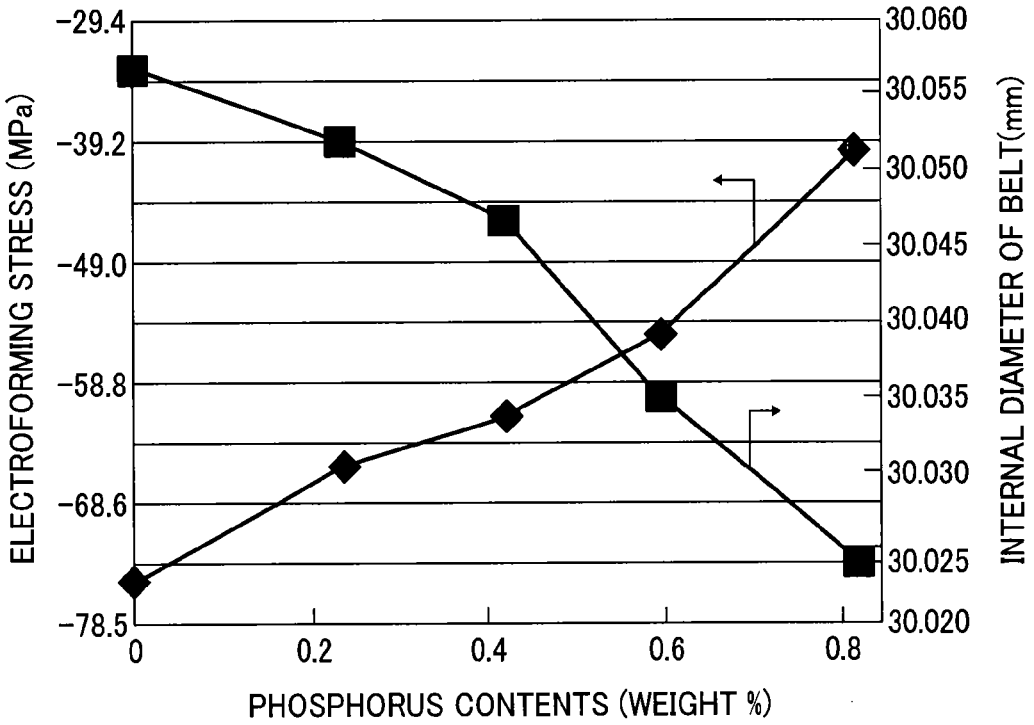
FIG. 8 is a graph illustrating a relation between an internal diameter (i.e., a belt inner diameter) of an electroformed film having a sleeve-shape, an electroforming stress of electroforming liquid, and the phosphorus content in an electroformed products (investigated in the basic study) according to one embodiment of the present invention.

As an initial basic study, a relation between the phosphorus content and mold releasability is described below. That is, an inner diameter of an electroformed sleeve state film (i.e., an inner diameter of a belt) obtained by the above-described method and an electroforming stress of the electroforming liquid are initially measured. Subsequently, a relation between these measuring results and the phosphorus content in the electroformed products is investigated and is obtained as shown in FIG. 8. Here, the inner diameter is measured by using a taper gauge. Whereas, an electroforming stress is measured by executing an electroforming stress test.

As understood from FIG. 8, as the phosphorus content increases, the electroforming stress decreases while minimizing the inner diameter of the sleeve state electroforming film. Here, when the inner diameter of the sleeve is 30.025 mm or less, mold releasing of the fixing belt substrate capable of accommodating an A3 (JIS) size sheet becomes difficult.

Now, a relation between the sulfur content and fracture toughness (e.g., tear strength) is described with reference to FIG. 4. Specifically, by supposing that a heating process is applied to the fixing belt to form a mold releasing layer thereon, a sample is similarly subjected to the heating process at 340 degree Celsius for one hour.

As understood from FIG. 4, when the sulfur content is 0.02 weight percent or more, the tear strength sharply drops while degrading the fracture toughness after the heating.

Now, a relation between the carbon content and micro-Vickers hardness is described with reference to FIG. 9. As understood from the graph, the micro-Vickers hardness accordingly increases as the carbon content increases.

Now, a relation between hardness and tensile strength is described with reference to FIG. 5 and applicable drawings.

Here, the tear strength of sleeve pieces having a different micro-Vickers hardness is investigated based on the sample subjected to the investigation of the relation between the carbon content and the micro-Vickers hardness, and is obtained as shown in FIG. 5.

As shown there, it is understood that as the hardness increases the tensile strength also increases. By contrast, when the hardness exceeds about 550, the tensile strength sharply drops.

Figure 9:
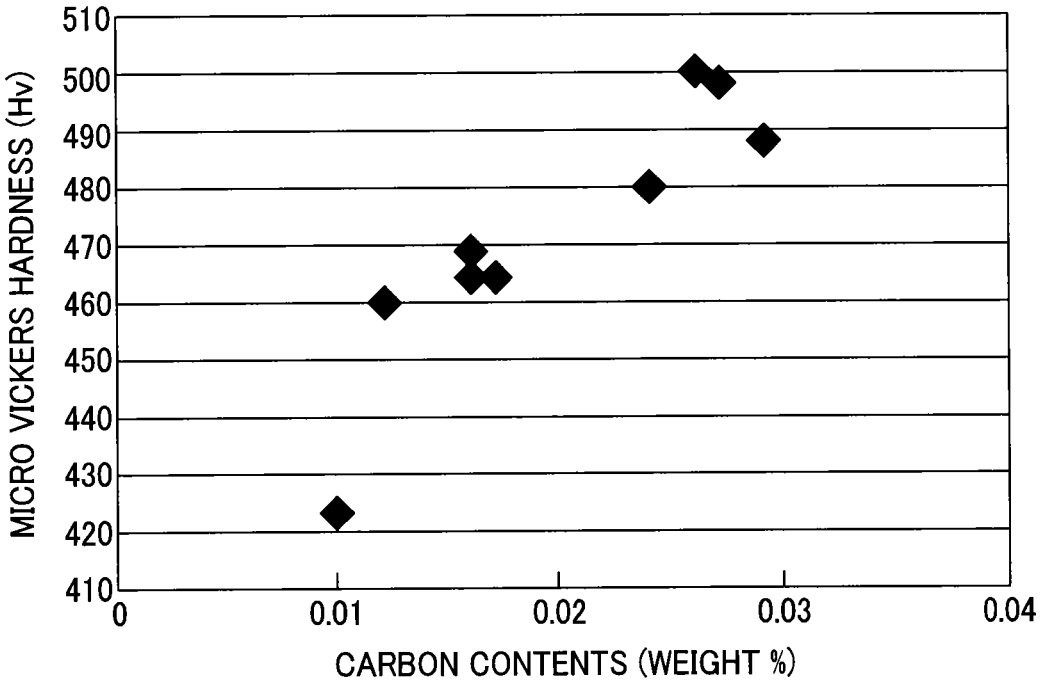
FIG. 9 is a graph illustrating a relation between the carbon content and micro-Vickers hardness (obtained in the basic study) according to one embodiment of the present invention.

It is also understood from FIG. 9 that since the tensile strength is relatively high especially when the micro-Vickers hardness is from about 460 or more to about 550 or less, durability and accordingly reliability of the fixing belt having the substrate made of such material can be upgraded.

Now, yet another basic study when a fixing device having a fixing belt with the substrate is used in an image forming apparatus is described. By using a similar manner to that described above, first to seventh practical examples and first to third comparative examples of the substrates respectively having different contents of phosphorus, sulfur, and carbon are prepared for the fixing belt. The elastic layer and the mold releasing layer are formed in this order as shown in FIG. 1 while overlying an outer circumferential surface of only the substrate of each of the first to seventh examples and the third comparative example in the respective fixing belts. Specifically, on the fixing belt substrate, the elastic layer is formed by executing die coat painting with silicone rubber. Subsequently, a surface activity process with ozone is applied, an adhesive layer is then coated, and a PFA coating process to form a thin film is subsequently applied thereto. Ultimately, a heating process at 340 degree Celsius is applied for one hour as a PFA heating process, thereby having prepared the respective fixing belts.

Subsequently, each of these fixing belts is built-in the fixing device of FIG. 2, and an image forming test is carried out in the image forming apparatus of FIG. 1. However, since it has a small inner diameter and the large phosphorus content as well, the fixing belt substrate of the third comparative example could not be separated from the mold, a fixing belt including the substrate could not be prepared, and accordingly the above-described test therefor is omitted.

As a result, each of the phosphorus, sulfur, and carbon contents included in the nickel that constitutes the fixing belt substrate and result of the image forming test (e.g., the number of copy sheets available) executed by using these substrates of the fixing belts is obtained as shown in Table 1.

TABLE 1

| | Phosphorus content (weight percent) | Sulfur content (weight percent) | Carbon content (weight percent) | micro-Vickers hardness (Hv) | Available number of sheets |
|---|---|---|---|---|---|
| First practical example | 0.4 | 0.003 | 0.012 | 450 | 400000 or more |
| Second practical example | 0.4 | 0.015 | 0.012 | 450 | 400000 or more |
| Third practical example | 0.4 | 0.02 | 0.012 | 450 | 400000 or more |
| Fourth practical example | 0.5 | 0.015 | 0.012 | 450 | 400000 or more |
| Fifth practical example | 0.7 | 0.015 | 0.012 | 450 | 400000 or more |

TABLE 1-continued

| | Phosphorus content (weight percent) | Sulfur content (weight percent) | Carbon content (weight percent) | micro-Vickers hardness (Hv) | Available number of sheets |
|---|---|---|---|---|---|
| Sixth practical example | 0.5 | 0.015 | 0.02 | 480 | 400000 or more |
| Seventh practical example | 0.5 | 0.015 | 0.024 | 550 | 400000 or more |
| First comparative example | 0.5 | 0.25 | 0.012 | 450 | 80000 or more |
| Second comparative example | 0.5 | 0.015 | 0.04 | 560 | 260000 or more |
| Third comparative example | 0.8 | 0.015 | 0.012 | 450 | — |

As obviously recognized from Table 1, the substrates of the fixing belts according to first to seventh practical examples do not raise a problem and show excellent durability even when multiple images are formed on more than forty-hundred thousand sheets having A-4 size (JIS). By contrast, fixing belts that employ the substrates of the first and second comparative examples are broken when image formation is executed on eighty thousands to two-hundred and sixty thousands of the A-4 sheets. Accordingly, it is confirmed that durability of the fixing belt obtained by using the substrate according to one embodiment of the present invention is effectively upgraded. Also, as shown in Table 1, since tensile strength of the fixing belt substrate is relatively high when micro-Vickers hardness is from about 460 or more to about 550 or less, durability and accordingly the reliability of the fixing belt can be upgraded in the range.

According to one aspect of the present invention, the fixing device including the fixing belt having the substrate can meet a demand for printing at high speed while saving energy. The fixing belt also can be durable even in a large load environment. Because, the fixing belt substrate is prepared by an electroforming process and contains nickel of prescribed weight percent, phosphorus of from about 0.4 weight percent or more to about 0.7 weight percent or less, sulfur of from about 0.003 weight percent or more to about 0.02 weight percent or less, and carbon of from about 0.012 weight percent or more to about 0.03 weight percent or less.

According to another aspect of the present invention, the fixing device including the fixing belt having the substrate can more effectively meet a demand for printing at high speed while saving energy. The fixing belt also can be more durable even in a large load environment. That is, the amount of phosphorus ranges from about 0.5 weight percent or more to about 0.7 weight percent or less, and the amount of sulfur is from about 0.012 weight percent or more to about 0.018 weight percent or less.

According to yet another aspect of the present invention, the fixing device including the fixing belt having the substrate can more precisely meet a demand for printing at high speed while saving energy. The fixing belt also can be more highly durable even in a large load environment. That is, a micro-Vickers hardness of the fixing belt substrate ranges from about 460 degrees or more to about 550 degrees or less.

According to yet another aspect of the present invention, the fixing device including the fixing belt having the substrate can more precisely meet a demand for printing at high speed while saving energy. The fixing belt also can be more highly durable even in a large load environment. That is, the micro-Vickers hardness of the fixing belt substrate of from about 460 degrees or more to about 550 degrees or less is obtained by appropriately adjusting the amount of carbon.

According to yet another aspect of the present invention, the fixing device including the fixing belt having the substrate can more precisely meet a demand for printing at high speed while saving energy. The fixing belt also can be more highly durable even in a large load environment. That is, the fixing belt is flexible and endless while accommodating a heater, and the fixing device includes a rotatable pressing roller pressed against the fixing belt that rotates the fixing belt, a fixed member disposed within a generally loop-shaped configuration of the fixing belt, and a reinforcing member reinforcing the fixed member. The fixed member creates a fixing nip on the fixing belt together with the pressing roller. The fixing belt includes a portion of reduced diameter to expand the fixing nip.

Numerous additional modifications and variations of the present invention are possible in light of the above teachings. It is therefore to be understood that within the scope of the appended claims, the present invention may be executed otherwise than as specifically described herein. For example, the order of steps for forming in the image forming apparatus is not limited to the above-described various embodiments and may be altered as appropriate.

What is claimed is:

1. A fixing belt substrate for an image forming apparatus, comprising:

nickel of prescribed weight percent;

phosphorus of from about 0.4 weight percent or more to about 0.7 weight percent or less;

sulfur of from about 0.003 weight percent or more to about 0.02 weight percent or less; and carbon of from about 0.012 weight percent or more to about 0.03 weight percent or less.

2. The fixing belt substrate as claimed in claim 1, wherein the amount of phosphorus ranges from about 0.5 weight percent or more to about 0.7 weight percent or less, and the amount of sulfur is from about 0.012 weight percent or more to about 0.018 weight percent or less.

3. The fixing belt substrate as claimed in claim 1, wherein a micro-Vickers hardness of the fixing belt substrate is from about 460 degrees or more to about 550 degrees or less.

4. The fixing belt substrate as claimed in claim 3, wherein the micro-Vickers hardness of the fixing belt substrate of from about 460 degrees or more to about 550 degrees or less is obtained by appropriately adjusting the amount of carbon.

5. The fixing belt substrate as claimed in claim 1, wherein the fixing belt is flexible and endless and accommodates a heater, a fixed member, and a reinforcing member reinforcing the fixed member inside a loop thereof, the fixed member creating a fixing nip on the fixing belt together with a pressing roller pressed against the fixing belt, the fixing belt having a portion of reduced diameter to expand the fixing nip, the fixing belt being driven and rotated by the pressing roller as the pressing roller rotates.

6. The fixing belt substrate as claimed in claim 1, wherein the fixing belt substrate is prepared by an electroforming process.

7. A fixing belt having a substrate, the substrate comprising:

nickel of prescribed weight percent;

phosphorus of from about 0.4 weight percent or more to about 0.7 weight percent or less;

sulfur of from about 0.003 weight percent or more to about 0.02 weight percent or less; and carbon of from about 0.012 weight percent or more to about 0.03 weight percent or less.

8. The fixing belt as claimed in claim 7, wherein the amount of phosphorus ranges from about 0.5 weight percent or more to about 0.7 weight percent or less, and the amount of sulfur is from about 0.012 weight percent or more to about 0.018 weight percent or less.

9. The fixing belt as claimed in claim 7, wherein a micro-Vickers hardness of the substrate is from about 460 degrees or more to about 550 degrees or less.

10. The fixing belt as claimed in claim 9, wherein the micro-Vickers hardness of the substrate of from about 460 degrees or more to about 550 degrees or less is obtained by appropriately adjusting the amount of carbon.

11. The fixing belt as claimed in claim 7, wherein the fixing belt is flexible and endless and accommodates a heater, a fixed member, and a reinforcing member reinforcing the fixed member inside a loop thereof, the fixed member creating a fixing nip on the fixing belt together with a pressing roller pressed against the fixing belt, the fixing belt having a portion of reduced diameter to expand the fixing nip, the fixing belt being driven and rotated by the pressing roller as the pressing roller rotates.

12. The fixing belt substrate as claimed in claim 7, wherein the fixing belt substrate is prepared by an electroforming process.

13. The fixing belt as claimed in claim 7, which comprises a releasing layer having a thickness in a range of from 4 μm to 20 μm.

14. The fixing belt as claimed in claim 7, which comprises a releasing layer having a thickness in a range of from 4 μm to 10 μm.

15. A fixing device comprising a fixing belt having a substrate, the substrate comprising:

nickel of prescribed weight percent;

phosphorus of from about 0.4 weight percent or more to about 0.7 weight percent or less;

sulfur of from about 0.003 weight percent or more to about 0.02 weight percent or less; and carbon of from about 0.012 weight percent or more to about 0.03 weight percent or less.

16. The fixing device as claimed in claim 15, wherein the amount of phosphorus ranges from about 0.5 weight percent or more to about 0.7 weight percent or less, and the amount of sulfur is from about 0.012 weight percent or more to about 0.018 weight percent or less.

17. The fixing device as claimed in claim 15, wherein a micro-Vickers hardness of the substrate is from about 460 degrees or more to about 550 degrees or less.

18. The fixing device as claimed in claim 17, wherein the micro-Vickers hardness of the substrate of from about 460 degrees or more to about 550 degrees or less is obtained by appropriately adjusting the amount of carbon.

19. The fixing device as claimed in claim 15, wherein the fixing belt is flexible and endless, the fixing device further comprising:

a heater disposed within a generally loop-shaped configuration of the fixing belt;

a rotatable pressing roller pressed against the fixing belt that rotates the fixing belt;

a fixed member disposed within the generally loop-shaped configuration of the fixing belt; and a reinforcing member to reinforce the fixed member, the fixed member creating a fixing nip on the fixing belt together with the pressing roller pressed against the fixing belt, the fixing belt having a portion of reduced diameter to expand the fixing nip.

20. The fixing device as claimed in claim 19, wherein the pressing roller is made of a water foamed silicone.

21. The fixing device as claimed in claim 15, wherein the fixing belt substrate is prepared by an electroforming process.

22. The fixing device as claimed in claim 15, wherein the fixing belt comprises a releasing layer having a thickness in a range of from 4 μm to 20 μm.

23. The fixing device as claimed in claim 15, wherein the fixing belt comprises a releasing layer having a thickness in a range of from 4 μm to 10 μm.

24. An image forming apparatus including a fixing belt having a substrate, the substrate containing:

nickel of prescribed weight percent;

phosphorus of from about 0.4 weight percent or more to about 0.7 weight percent or less;

sulfur of from about 0.003 weight percent or more to about 0.02 weight percent or less; and carbon of from about 0.012 weight percent or more to about 0.03 weight percent or less.

25. The image forming apparatus as claimed in claim 24, wherein the amount of phosphorus ranges from about 0.5 weight percent or more to about 0.7 weight percent or less, and the amount of sulfur is from about 0.012 weight percent or more to about 0.018 weight percent or less.

26. The image forming apparatus as claimed in claim 24, wherein a micro-Vickers hardness of the substrate is from about 460 degrees or more to about 550 degrees or less.

27. The image forming apparatus as claimed in claim 26, wherein the micro-Vickers hardness of the substrate of from about 460 degrees or more to about 550 degrees or less is obtained by appropriately adjusting the amount of carbon.

28. The image forming apparatus as claimed in claim 24, wherein the fixing belt is flexible and endless accommodating a heater, the image forming apparatus further comprising:

a rotatable pressing roller pressed against the fixing belt that rotates the fixing belt;

a fixed member disposed within a generally loop-shaped configuration of the fixing belt; and a reinforcing member reinforcing the fixed member, the fixed member creating a fixing nip on the fixing belt together with the pressing roller, the fixing belt having a portion of reduced diameter to expand the fixing nip.

29. The image forming apparatus as claimed in claim 24, wherein the substrate is prepared by an electroforming process.

30. The image forming apparatus according to claim 24, wherein the fixing belt comprises a releasing layer having a thickness in a range of from 4 μm to 20 μm.

31. The image forming apparatus according to claim 24, wherein the fixing belt comprises a releasing layer having a thickness in a range of from 4 μm to 10 μm.

32. A fixing belt having a substrate, the substrate comprising:

nickel of prescribed weight percent;

phosphorus of from about 0.4 weight percent or more to about 0.7 weight percent or less; and sulfur of from about 0.003 weight percent or more to about 0.02 weight percent or less.

33. The fixing belt as claimed in claim 32, wherein the amount of phosphorus ranges from about 0.5 weight percent or more to about 0.7 weight percent or less, and the amount of sulfur is from about 0.012 weight percent or more to about 0.018 weight percent or less.

34. The fixing belt as claimed in claim 32, wherein a micro-Vickers hardness of the substrate is from about 460 degrees or more to about 550 degrees or less.

35. The fixing belt as claimed in claim 34, wherein the micro-Vickers hardness of the substrate of from about 460 degrees or more to about 550 degrees or less is obtained by appropriately adjusting the amount of carbon.

36. The fixing belt as claimed in claim 32, wherein the fixing belt is flexible and endless and accommodates a heater, a fixed member, and a reinforcing member reinforcing the fixed member inside a loop thereof, the fixed member creating a fixing nip on the fixing belt together with a pressing roller pressed against the fixing belt, the fixing belt having a portion of reduced diameter to expand the fixing nip, the fixing belt being driven and rotated by the pressing roller as the pressing roller rotates.

37. The fixing belt substrate as claimed in claim 32, wherein the fixing belt substrate is prepared by an electroforming process.

38. A fixing device comprising the fixing belt as claimed in claim 32.

39. An image forming apparatus comprising the fixing belt as claimed in claim 32.

40. The fixing belt as claimed in claim 32, which comprises a releasing layer having a thickness in a range of from 4 μm to 20 μm.

41. The fixing belt as claimed in claim 32, which comprises a releasing layer having a thickness in a range of from 4 μm to 10 μm.

42. The fixing belt as claimed in claim 32, wherein the pressing roller is made of a water foamed silicone.

* * * * *